US005737954A

United States Patent [19]

Yasui

[11] Patent Number: 5,737,954

[45] Date of Patent: Apr. 14, 1998

[54] SUPERPLASTIC FORMING WITH DIRECT ELECTRICAL HEATING

[75] Inventor: Ken K. Yasui, Huntington Beach, Calif.

[73] Assignee: McDonnell Douglas Corporation, Huntington Beach, Calif.

[21] Appl. No.: 749,904

[22] Filed: Nov. 15, 1996

[51] Int. Cl.[6] ..... B21D 26/02

[52] U.S. Cl. ..... 72/60; 72/342.96; 72/709

[58] Field of Search ..... 72/342.96, 60, 72/709

[56] References Cited

U.S. PATENT DOCUMENTS

| | | | |
|---|---|---|---|
| 3,567,524 | 3/1971 | Cook et al. | 72/709 |
| 3,606,778 | 9/1971 | Bomberger | 72/342.96 |
| 4,532,793 | 8/1985 | Bezold | 72/342.96 |
| 5,129,248 | 7/1992 | Yasui | 72/60 |
| 5,205,470 | 4/1993 | Cadwell | 72/60 |
| 5,277,045 | 1/1994 | Mahoney et al. | 72/60 |
| 5,592,842 | 1/1997 | Nyrhila | 72/60 |

*Primary Examiner*—David Jones
*Attorney, Agent, or Firm*—Bell, Seltzer, Park & Gibson, P.A.

[57] ABSTRACT

Sheet materials are superplastically formed and optionally diffusion bonded into structures, by directly electrically resistance heating the sheets and forming them with a controlled gas-mass flow while the dies in which they are formed may remain relatively cool. The dies include electrodes and thermocouples placed therein, and gas interface ports that connect to the sheets to be formed to allow rapid formation of structures. Some of the gas interface ports may become sealably attached to the part during the formation process so that the structures may be removed from the dies hot, thus allowing a high die throughput.

25 Claims, 11 Drawing Sheets

SUPERPLASTIC FORMING WITH DIRECT ELECTRICAL HEATING

FIELD OF THE INVENTION

This invention relates to the field of metal forming and, more particularly, to the production forming and diffusion bonding of metal sheets, which exhibit superplastic characteristics, by directly electrically resistance heating the sheets and forming them with a controlled gas-mass flow, which has a capability of self-regulating forming pressure according to the forming temperature.

BACKGROUND OF THE INVENTION

Superplasticity is the characteristic demonstrated by certain metal alloys that exhibit extremely high plasticity. These alloys develop high tensile elongations with minimum necking when deformed within specific temperature ranges and limited strain rate ranges. The methods used to form and in some cases diffusion bond superplastic materials capitalize on this characteristic and typically employ gas pressure to form sheet material into or against a heated configurational die in order to form the part. Normally the one or more sheets to be formed are sealed about their perimeters into a forming pack with gas pressure tubes welded to the pack to communicate pressurized inert gas used to form the part out of the forming pack. The edge and tube welding usually must be done by hand and gas leaks from faulty welds are a common cause of process failure.

Once sealed around its perimeter, the forming pack is placed between heated dies, that are usually below superplastic forming temperature. The temperature of the dies is then elevated so that the forming pack gradually heats up to superplastic forming temperature. No matter what the temperature of the dies when they are loaded with sheets to be formed, a substantial time must elapse before forming starts. The time enables the sheets to reach temperature equilibrium there across. The sheets are heated conductively from the edges of the dies, radiantly from the dies and to a lessor extent convectively by atmospheric gas within the dies, which are not particularly efficient heat transfer mechanisms. It is critical in most superplastic forming processes, which control the pressure of the forming gas that the sheets of the forming pack be heated to a known, controlled, uniform temperature since pressure control relies on the superplastic characteristics from sheet to sheet being identical, which in large measure depend on the assumption that the sheets do not have a temperature gradient there across.

Pressurized inert gas is then used to form the forming pack into the desired part in the dies. Before the part can be removed from the dies, the dies and the parts are cooled at least to the temperature where the superplastically formable sheets can maintain dimensional stability. The dies then are opened and the part is removed from the dies, ready for trimming and surface finishing. The dies are massive structures and have a considerable heat capacity, especially when compared to the forming pack. The high heat capacities and relatively small surface areas of the dies result in considerable time being required to heat and cool them during a process cycle. The continual heating and cooling of the dies, and the maintenance thereof at elevated temperatures, reduces the useful lives of the dies and results in a high energy cost for the process.

Diffusion bonding is frequently associated with superplastic forming processes. U.S. Pat. No. 3,340,101 to D. S. Fields, Jr. et al.; U.S. Pat. No. 4,117,970 to Hamilton et al.; U.S. Pat. No. 4,233,829 to Hamilton et al.; and U.S. Pat. No. 4,217,397 to Hayase et al. are all basic patents, with various degrees of complexity, relating to superplastic forming. All of these patents teach processes which attempt to control stress, and thereby strain, by controlling the pressure in the forming process versus time.

Exceptions to controlling forming rates by controlling pressure versus time are taught in U.S. Pat. No. 4,708,008 to Yasui et al. and U.S. Pat. No. 5,129,248 to Yasui. Yasui et al. teaches measuring and controlling the volume displaced by the forming pack being formed so as to measure total strain or surface area increase of the sheets thereof while Yasui teaches an apparatus and method for controlling superplastic forming processes by measuring and controlling the gas-mass flow rate of the gas displaced as a blank is being formed.

U.S. Pat. No. 4,489,579 to Daime et al. also teaches controlling a superplastic forming process by controlling pressure versus time, but also teaches additional devices for monitoring the forming rate by providing a tube that penetrates the die and engages a portion of the blank to be formed. As the blank is formed, the tube advances out through the die as that portion of the blank is formed to provide a direct indication of the formation. Means are also provided to produce electrical signals at predetermined amounts of advancement of the tube, which allows the operator to evaluate the developmental process of the part. However, it is not very practical to have a sliding tube probe with the associated geometric disturbance at the contact point, nor is it practical to provide electrical instrumentation in the harsh high temperature environment needed for superplastic forming.

Others have attempted to provide means to eliminate the requirement for welding gas tubes to a forming pack. A gas inlet formed in a die is shown in U.S. Pat. No. 5,069,383 by Cooper et al., but it is useful only in special circumstances and occasionally fails to provide a seal. Another gas inlet formed in a die is shown in U.S. Pat. No. 4,331,284 by Schultz et al. but it depends on a surrounding die ring and die force to maintain the seal. As pressure increases, the Schultz seal structure is more likely to leak.

Excessive strain rates during a superplastic forming process can cause rupture and must be avoided in the forming process. In order to understand excessive strain rates, it is necessary to understand the relationship between the variables in superplastic forming which are represented by the classic equation $$\sigma = K\dot{\epsilon}^m$$

where m is the strain rate sensitivity, $\sigma$ is stress, $\dot{\epsilon}$ is strain rate, and K is a constant.

In the absence of strain hardening, the higher the value of m, the higher the tensile elongation. Solving the equation for m, $$m = \frac{\ln\sigma - \ln K}{\ln\dot{\epsilon}}$$

In addition to strain rate, the value of m is also a function of temperature and microstructure of the material. The uniformity of the thinning under biaxial stress conditions also correlates with the value of m. For maximum deformation stability, superplastic forming is optimally performed at or near the strain rate that produces the maximum allowable strain rate sensitivity. However, because the strain rate sensitivity, m, varies with stress as well as temperature and microstructure, m constantly varies during a forming process.

Furthermore, the strain rate varies at different instances of time on different portions of the formation inasmuch as stress levels are non-uniform. The more complex the part, the more variation there is, and, therefore, strain rate differs over the various elements of the formation. Since strain rate, stress, temperature and microstructure are all interdependent and varying during the process, the relationship is theoretical. As a practical matter, there is no predictable relationship that can be controlled so as to form all portions of complex parts at the optimum strain rate sensitivity and therefore the optimum strain rates. However, the artisan can plot strain rate sensitivity (m) against strain rate ($\dot{\epsilon}$) and stress ($\sigma$) against strain rate ($\dot{\epsilon}$) and establish the best compromise ranges to be used as guides. Prior to Yasui, those skilled in the art had to select and control those portions of the formation, which are more critical to successful forming, while maintaining all other portions at the best or less than the best strain rates, which necessarily becomes the overall optimum rate.

Superplastic forming is further complicated when a part or panel configuration requires deep forming. When the deep forming is occurring, precise pressures must be used because of the high thinning rate of the material. However, it is not always possible to determine if the forming pack is at a state of formation where the deep forming is occurring, so the pressure can be reduced at the proper time. When the pressure is too high during deep forming, a blowout can occur reducing the partly formed pack to scrap.

By controlling the process with either pressure or perhaps volume alone, only one of the variables in Boyle's Law $$\frac{P_1 \times V_1}{T_1} = \frac{P_2 \times V_2}{T_2}$$

(where P, V, and T represent pressure, volume, and temperature, respectively) was used to control the process. Yasui found that the process was much more stable when instead of controlling pressure, which was the accepted practice at the time, the flow of the mass of gas used to form was controlled. The stability of this process is due to the recognition that if a controlled gas-mass flow rate is introduced, when the forming blank is being strained too slowly, the pressure will build up until the applied stress increases to increase the strain rate. When the blank is forming too fast, the pressure drops or at least its rate of increase diminishes to slow down the strain rate due to volume increase. There also has been a need to monitor superplastic forming, or superplastic forming and diffusion bonding processes for early detection of departure from the desired process, so that corrections can be made before the forming part is ruined.

SUMMARY OF THE INVENTION

This invention teaches the use of electrical resistance heating of one or more sheets used in a superplastic forming and optionally diffusion bonding process. The dies are not used to heat the sheet(s) and therefore can be maintained at lower temperatures, especially when made from material with heat insulative qualities such as ceramic. Preferably the dies include means that establish gas interfaces with a forming pack of sheets inserted there between so that only roll seam welding need be used to form multi-sheet panels. Electrical resistance heating is not always as uniform as radiant and conductive heating from a pair of heated dies, but it is much faster and requires much less energy. The small non-uniform heating that results because of the rapid electrical resistance heating can be accommodated when gas-mass forming is used, as described by Yasui in U.S. Pat. No. 5,129,248. In addition, the electrical current can be applied at different locations and/or rates along the edges of the forming pack to minimize non-uniform heating. Since the dies are relatively cool, once the electrical current is stopped, the formed part quickly cools to a temperature where it can be handled outside the dies especially if it is being purged with cool inert gas. In one embodiment of the invention, one or more gas passages to the interior of the part are diffusion bonded to the part as the part is superplastically formed so that the purging of the interior of the part can be continued with the part out of the dies until the part is below a temperature where surface oxidation takes place. This allows a pair of dies to have a much larger throughput than heretofore has been possible.

The gas-mass forming process can be monitored by preparing a chart or data base using expected initial conditions of volumes, temperature, gas constant, and pressure to develop a curve showing the forming volume increase on a graph of pressure versus cumulative gas-mass. The actual pressures and cumulative gas-mass are plotted and compared to the constant volume curves. Departures from the desired process show up as characteristic abnormal places in the plotted pressure curve, which allow the process to be corrected and continued. In addition, the plotted pressure curves provide information as to the desired progress of the process including when it is complete. The observation of the departures and corrective action normally are manual for experimental parts or small production runs. For large production runs, a personal computer with neural net programming and interface cards for making the needed changes to the process, usually by adjusting the gas-mass flow rate and/or the temperature can be used. The plotting of the actual pressures and cumulative gas-mass and the constant volume curves can be done automatically on a CRT for manual observation. Usually the initial gas-mass flow rate is chosen empirically according to the size and shape complexity, and then it is gradually increased with each identical part until a process departure is observed, so that the parts are made as fast as safely possible. With automatic control, it is possible to provide variation in gas-mass flow rate during the formation of a part to further speed up the process during times when volume is increasing at a high rate because of the geometry of the part. Since the monitoring allows an artisan to know the progress of the forming process, variable rate gas-mass forming is also possible manually. However, the manual attention required is rarely worth the cost saving except for experimental parts.

It therefore is an object of the present invention to provide a production process for rapid formation of superplastically formed parts that uses electrical resistance heating of the forming pack.

Another object of this invention is to reduce the energy cost of superplastic forming, diffusion bonding processes.

Another object of this invention is to provide die tooling for superplastic formation of parts, which is energy efficient and has a long lifetime.

Another object of this invention is to eliminate the need for thermal cycling of the dies used in superplastic forming, diffusion bonding processes.

These and other objects and advantages of the present invention will become apparent to those skilled in the art after considering the following detailed specification, together with the accompanying drawings wherein:

DETAILED DESCRIPTION OF THE INVENTION

The present invention includes using electrical heating of the work piece in a superplastic forming process that may include diffusion bonding, instead of relying on heated forming dies to heat the work piece. Generally, in the past, the workpiece has required hours to heat up from room temperature to superplastic forming temperature (about 1650° F.) even when it is placed in warm (about 900° F.) dies whose temperature is then raised to the superplastic forming temperature.

Figure 1:
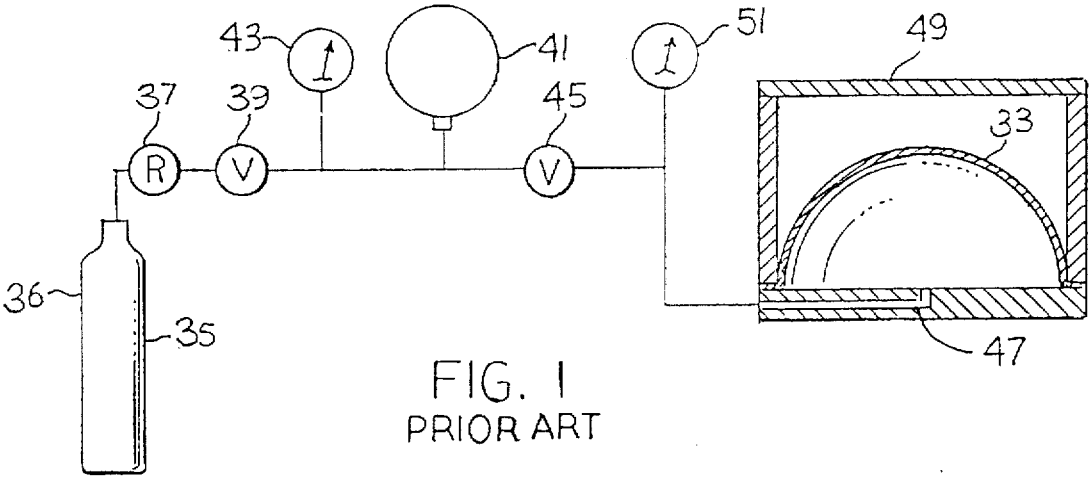
FIG. 1 PRIOR ART
FIG. 1 schematically shows the prior art Yasui forming apparatus and the associated accumulator type controller device.

FIG. 1 is a schematic of a simple prior art apparatus, which is used to control the mass flow of the inert gas to superplastically form a single sheet 33. The source 35 of the gas, usually an argon gas bottle 36, is fed through a pressure regulator 37 followed by a shut-off valve 39. When the shutoff valve 39 is open, the inert gas is fed to an accumulator 41, which is sized according to the cavity volume of the part to be formed. A pressure gage 43 is used to read the pressure in the accumulator 41.

A throttling valve 45 is used to control the gas flow from the accumulator 41 through the base 47 of configurational die 49, which in this example has a simple cylindrical shape. The forming pressure is indicated on the pressure gage 51 downstream of the valve 45. The accumulator 41 is initially pressurized to a predetermined pressure by opening valve 39 and having the pressure regulator 37 set at a predetermined controlling pressure. Once the accumulator 41 is charged to the predetermined pressure at a known temperature and volume, the mass of the gas in the accumulator 41 is readily calculated. The valve 39 is closed and the gas in accumulator 41 is introduced through the valve 45 into the forming sheet 33 until the pressure falls to a precalcuated minimum pressure, thereby controlling the gas-mass flow in predetermined amounts in short intervals with minimal pressure change. When the accumulator pressure drops to the predicted level, valve 45 is closed and valve 39 is opened to re-charge the accumulator 41 to the predetermined pressure and thereby a predetermined mass. The procedure is then repeated as many times as is required to assure full formation of the sheet 33 into the cylindrical configuration of the die 49. The flow rate range is controlled by changing the combination of operation frequency of valves 39 and 45, and the pressure and size of the accumulator 41.

Figure 2:
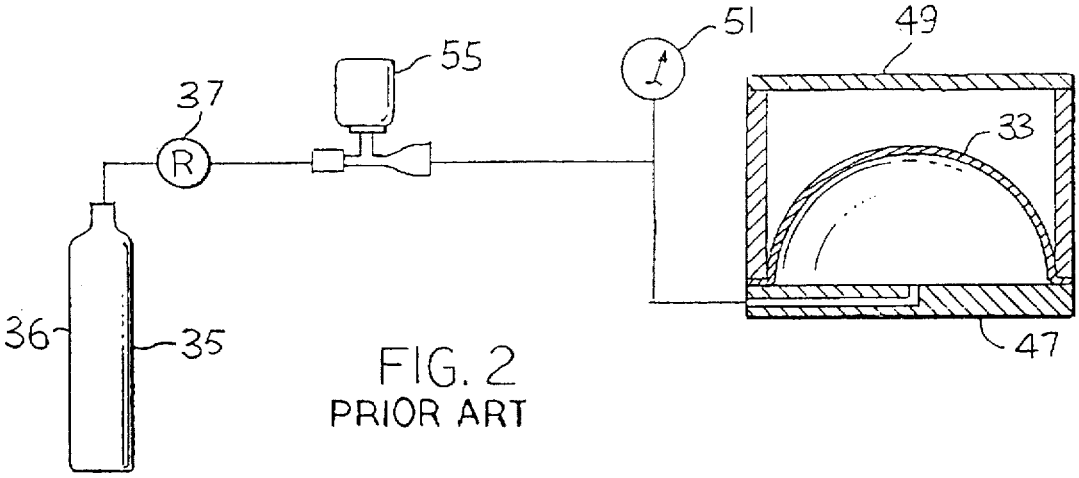
FIG. 2 PRIOR ART
FIG. 2 is an alternate controlling device to that shown in FIG. 1 using a gas mass flow controller.

As shown in FIG. 2, a mass flow controller 55 may replace the accumulator 41, the shut-off valve 39, and throttling valve 45 so that the gas-mass process can be controlled directly from the regulator 37. Suitable mass flow controllers for this purpose are commercially available. The specific model required is determined by the mass flow range required to form a specific specimen. A more sophisticated system may be provided with a neural net program running in a personal computer and an electrically controlled mass flow controller.

Heretofore, no matter what method was used to control the pressure of the forming gas, initial analytical steps were required. The relationship between stress, $\sigma$, and strain rate, $\dot{\epsilon}$, at the forming temperature for any given material had be established either analytically or experimentally. Using this data, total deformation of the part being formed was approximated by analyzing the geometry of the particular part being formed as a function of applied stress. Accurate stress versus time curve can usually be established computationally for most structures. However, these analyses are very time consuming in light of the many variables and are subject to deviations due to material and process parameters variations. The substantial benefit of gas-mass flow control as compared to pressure control is realized in the least amount of analysis required.

Figure 3:
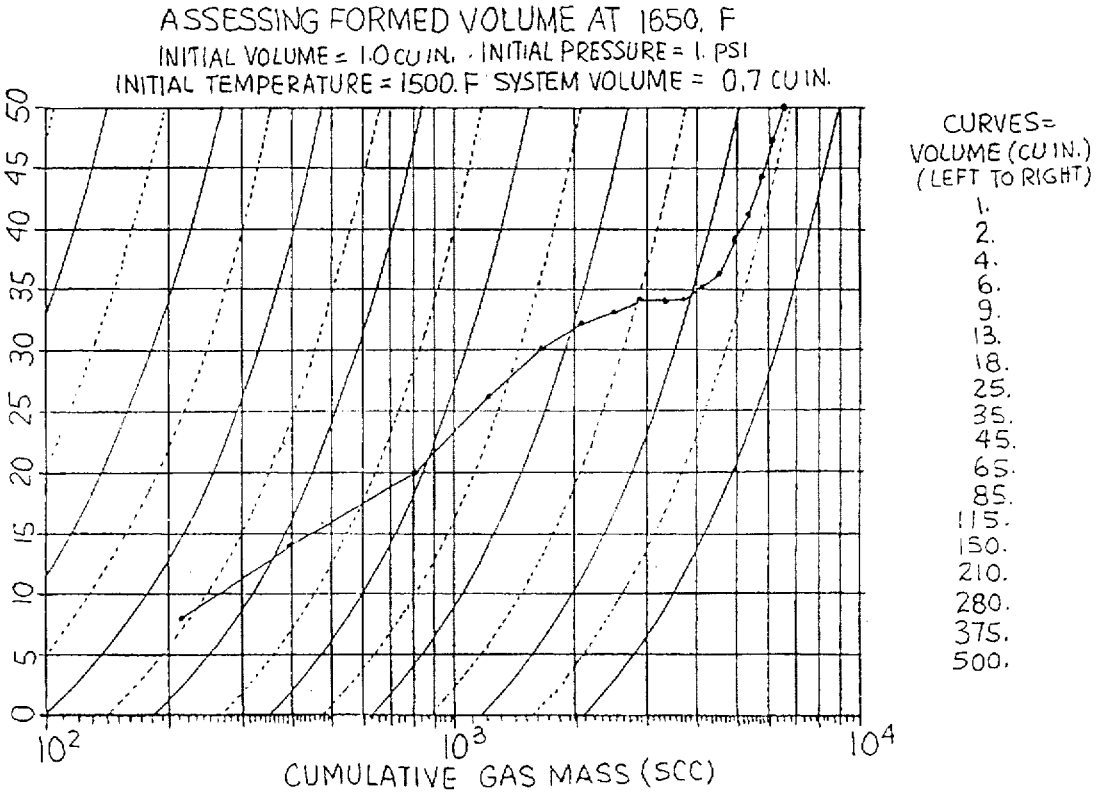
FIG. 3 is a chart of constant volume curves on a graph of forming pressure versus a logarithmic scale of cumulative gas-mass with a typical forming plot for a single sheet part.

The pre-analysis can be eliminated by generating a chart or data base of constant volume curves on a plot of forming pressure versus a logarithmic scale of cumulative gas-mass as shown in FIG. 3. The chart is an expression of the general gas law $$pv=mRT$$

where m is the mass of gas at absolute temperature, T, and R is a constant that depends on the units. The chart of FIG. 3 is easily calculated with a simple program and a desktop computer from inputs of initial volume, pressure, temperature and process system volume, and final maximum forming volume and forming temperature. In the case of FIG. 3, the initial volume of the part is 1.0 $in^3$, initial pressure is 1.0 psi, initial temperature is 1500° F. and the system for providing the gas has a volume of 0.7 $in^3$. The volume of the die was four hundred seventy $in^3$, while the final volume of the part was about three hundred sixty $in^3$. The difference is due to the volume of the part material and because the test part was not fully formed into the mold, allowing the removal of the part with less effort. The early part of the constant volume curve and volume data when the part was being heated from 1500° F. to 1650° F. are slightly inaccurate, because they are plotted on a 1650° F. graph. However the trends thereof accurately show the progress of the process and the values become accurate toward the end of the process when exact numbers are needed.

Figure 4:
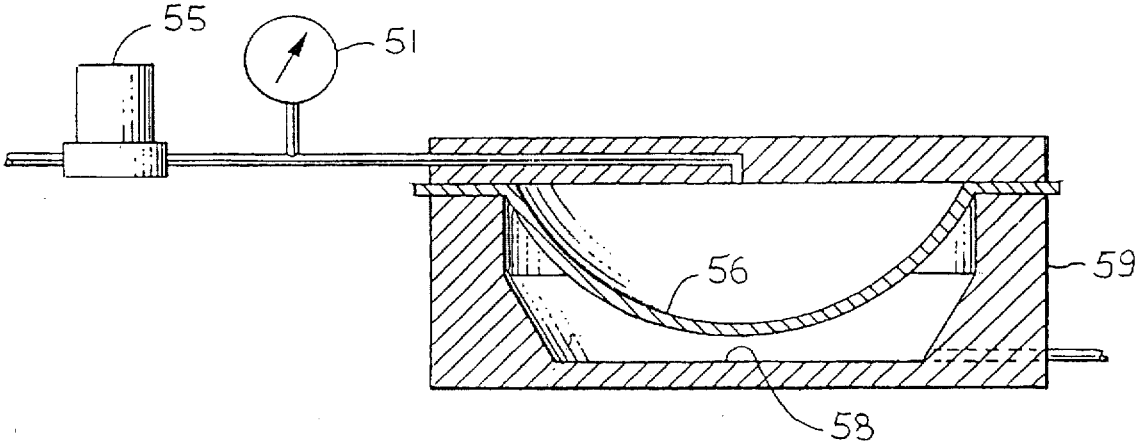
FIG. 4 is a cross-sectional view through a die and a single sheet part as the part is being formed, for the process documented by the plot of FIG. 3.

The pressure and cumulative gas-mass is then plotted either manually or automatically and the resultant curve is compared to the ideal constant volume curves. The expected final volume of a part is usually easily calculated, especially if computer designed. In FIG. 3, for a single sheet part 56 shown in formation in FIG. 4, the rise in pressure increase rate starting at about 800 scc is due to higher forming stress before the final forming temperature of 1650° F. was reached. At about 1700 scc, the temperature became high enough that the pressure increase rate began to decrease until contact of the sheet 56 to the bottom surface 58 of the die 59 occurred, which can be seen by the change of slope at about 3800 scc. The part would have reached its fully formed shape at about 100 psi where the plot would have paralleled the three hundred seventy five $in^3$ line at about four hundred and fifty $in^3$. Thus controlling gas-mass flow rate and plotting cumulative gas-mass against forming pressure allows much more precise control over superplastic forming processes so that quick electrical heating of the workpiece can be used in production processes.

Figure 5:
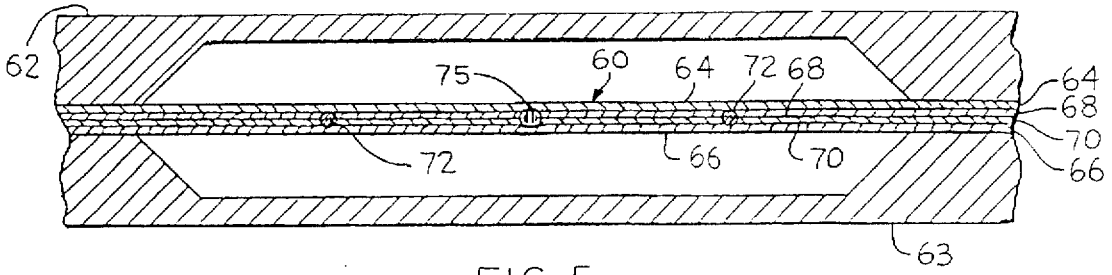
FIG. 5 is a cross-sectional view of a four-sheet assembly employing a face sheet pressure equalization hole for constructing an SPF/DB panel in place in a pair of dies prior to the application of pressure.

In production processes, workpiece preparation and the time a workpiece is in a die must be minimized. One way to reduce workpiece preparation is to reduce the number of gas passages that must be connected to a forming pack. In FIG. 5, a four sheet fabrication assembly 60 has been positioned between dies 62 and 63 for the performance of a superplastic forming, diffusion bonding (SPF/DB) process to form a panel as shown by Hayase. The assembly 60 includes upper and lower face sheets 64 and 66 and upper and lower inner core sheets 68 and 70. The material of the sheets 64, 66, 68, and 70 to be superplastically formed must exhibit the characteristic of unusually high tensile elongation with minimum necking when formed within a limited temperature and strain rate range. Titanium alloys are the preferred sheet material although some other alloys are also superplastically formable. The superplastic temperature range varies with the specific alloy used. This temperature for most titanium alloys is between 1400° F. and 1750° F. The strain rate is easily regulated by controlling the gas-mass flow rate used to form the sheets. If the strain rate is too high the sheet material being formed will blow out, and if the rate is too low, the material looses some of its plasticity, and the process costs are increased by excessive labor and energy usage, and the reduced production availability of expensive hot press resources.

The material of the sheets 64, 66, 68, and 70 also must be suitable for diffusion bonding. Diffusion bonding refers to the solid state joining of surfaces of similar or dissimilar metals by applying heat and pressure for a time duration long enough to cause co-mingling of the atoms at the joint interface. This is distinguished from fusion bonding or welding, which is the metallurgical joining or welding of surfaces of similar or dissimilar metals by applying enough heat to cause the materials at the joint interface to reach liquid states and thereby merge into an integral solid when cooled.

Figure 6:
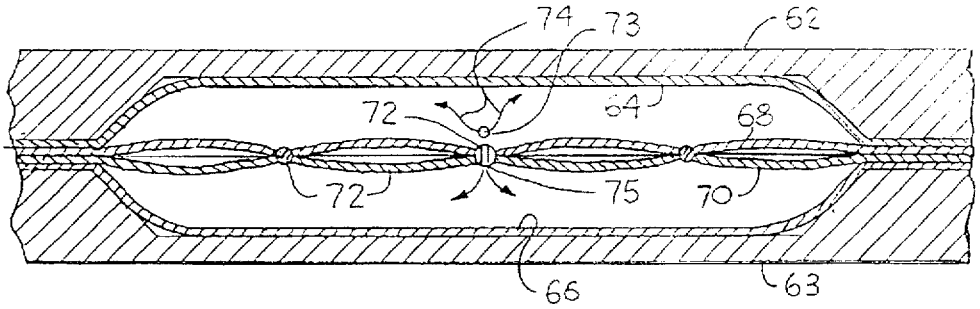
FIG. 6 is a cross-sectional view of the four-sheet assembly of FIG. 5 where the face sheets thereof are just about formed into their final position within the dies.

The assembly 60 of FIG. 5 has its core sheets 68 and 70 connected by linear seam welds 72, at least part of which are intermittent to allow gas flow along the mating surfaces of the core sheets 68 and 70. To perform the forming and bonding process, the assembly 60 is heated to approximately 1650° F. for the most common Ti-6Al-4V alloy and pressurized inert gas is introduced between the sheets 64, and 68, and 66 and 70 of the assembly 60 through a gas passage 73 that is shown passing though face sheet 64 in FIG. 6. The gas, shown by arrows 74, equalizes by passing through a hole 75 drilled or otherwise formed through the core sheets 68 and 70, with the hole 75 being centered in a weld bead 72. One or more holes 75 may be present to assure pressure equalization between the face sheets 64 and 66. Prior similar processes use a bifurcated tube that passes through sheets 64 and 66 or between sheets 64 and 68, and 66 and 70. If one of the bifurcated passages clog, the face sheets forming the envelope expand asymmetrically. Although this tends to happen at the end of the face sheet forming process, the impact is to shift the core sheets 68 and 70 toward one or the other face sheet 64 or 66 causing asymmetry in the finished part. Since the inert gas 74 is constantly flowing through the hole 75, the hole 75 remains open as long as it is needed. The inert gas 74 at equalized pressure on the face sheets 64 and 66 causes the face sheets 64 and 66 to superplastically form outwardly into the shape of the dies 62 and 63, as shown in FIG. 6. A slightly higher pressure is applied between the core sheets 68 and 70 through gas passage 76 (FIG. 7) so that the core sheets 68 and 70 expand a small amount and do not diffusion bond together while the face sheets 64 and 66 are being formed.

Figure 7:
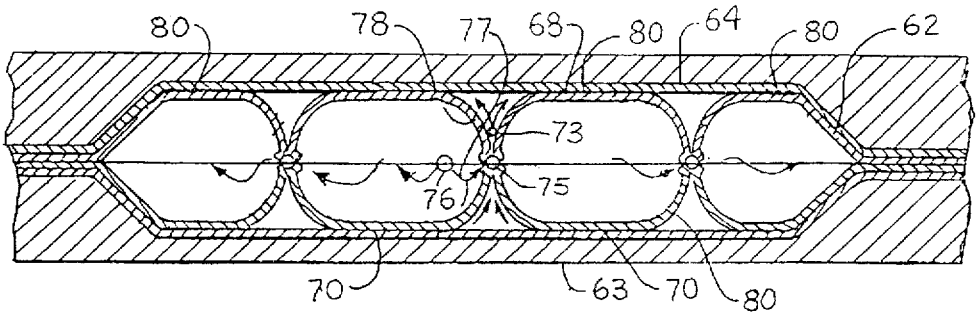
FIG. 7 is a cross-sectional view of the four-sheet assembly of FIGS. 5 and 6 where the core sheets thereof are being formed.
Figure 8:
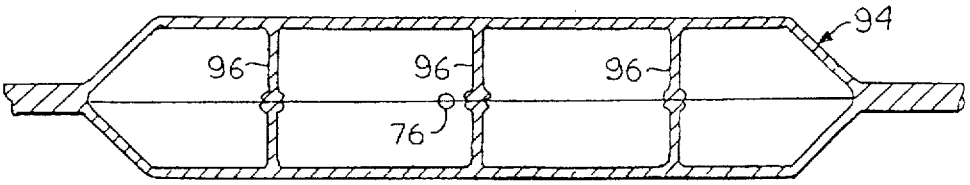
FIG. 8 is a view of the panel being formed in FIGS. 5, 6 and 7 after forming is complete.

Once the face sheets 64 and 66 have reached their final positions against the dies 62 and 63, as shown in FIG. 7, the pressure of the inert gas 74 between the face sheet 64 and the core sheet 68 and the face sheet 66 and core sheet 70 is held at a value sufficient to maintain the face sheets 64 and 66 in position. Generally, about 50 psi is maintained with additional pressure being required when thick face sheets 64 and 66 are used. Thereafter sufficient pressurized inert gas 77 is introduced through the gas passage 76 between the core sheets 68 and 70 to cause them to balloon outwardly except where connected together by the intermittent linear seam welds 72. If, for example, the inert gas 77 is introduced at the back of longitudinal "balloon" 78, the gas 77 travels through openings formed by the intermittent portions of the welds 72 to pressurize all of the other balloons 80. The flow of inert gas 77 is continued until the balloons 78 and 80 engage each other and the face sheets 64 and 66, to form the panel 94 with vertical webs 96 shown in FIG. 8. The gas 74 is exhausted out of the gas passage 73, but no differential pressure ever exists across the core sheets 68 and 70 because of the hole 75. The hole 75 becomes very small in diameter as the core sheets 68 and 70 complete their diffusion bonding, but remains open because as the radius of the hole 75 becomes almost infinitely small, its strength against further reduction in radius increases in inverse proportion to the radius.

Figure 9:
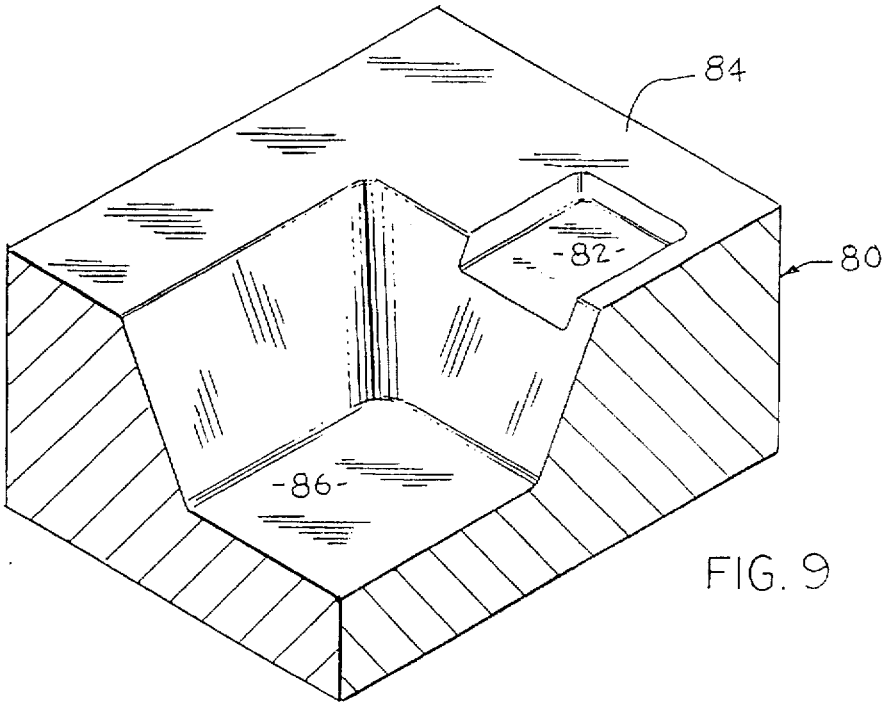
FIG. 9 is a perspective view of a portion of a modified die useful in practicing the present invention.
Figure 10A:
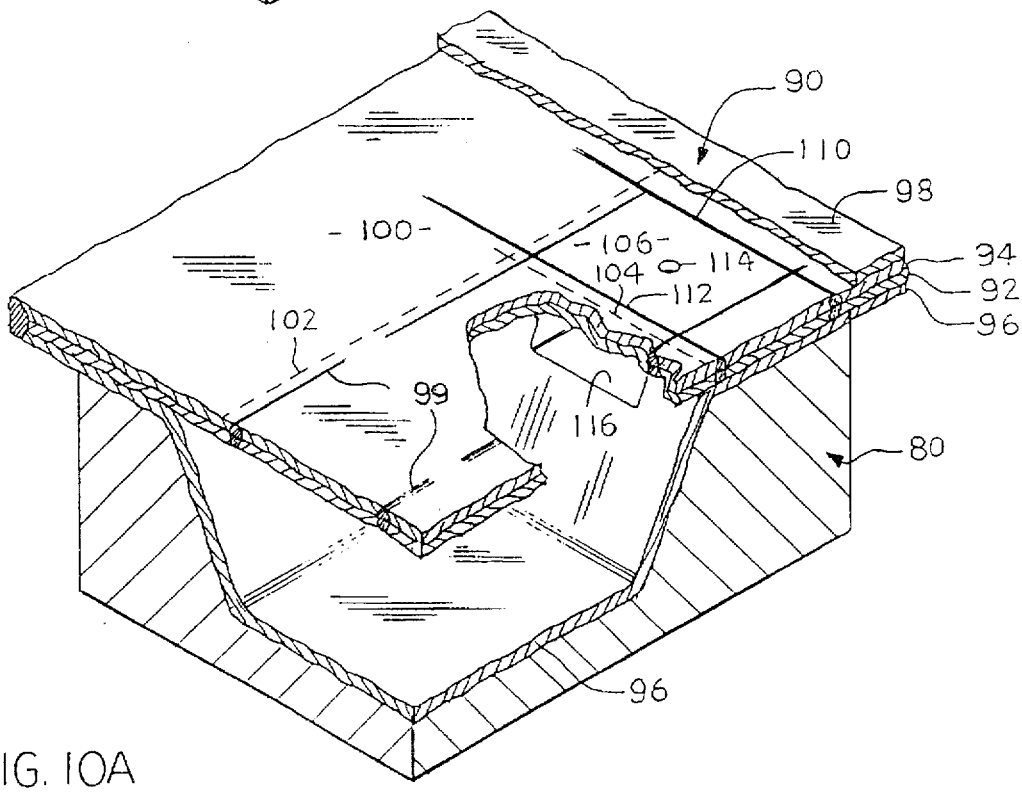
FIG. 10A is a perspective view of the die of FIG. 9 with a portion of a SPF/DB panel partially formed therein showing an embodiment of the present invention that uses a weld seal area in the waste portion of the part blank to provide the face sheet pressure equalization hole.
Figure 10B:
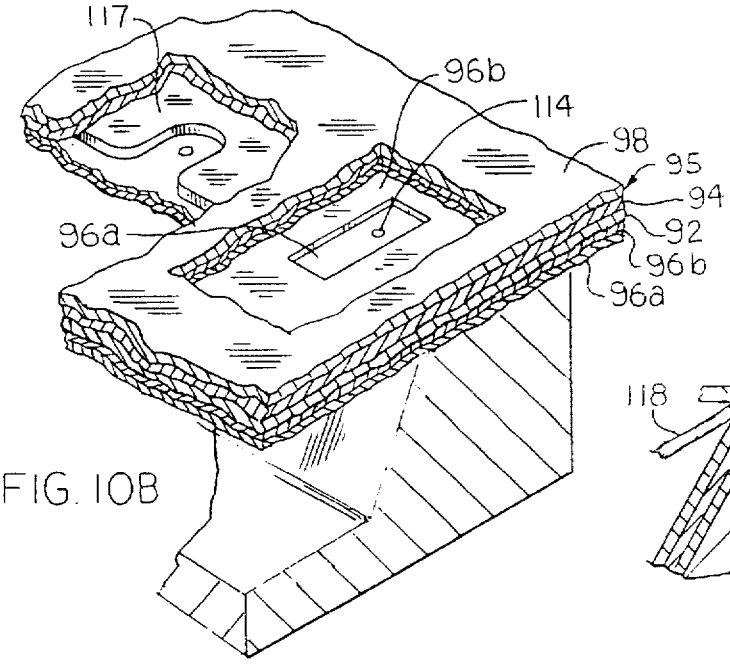
FIG. 10B is a perspective view of a die similar to that of FIG. 9 showing how multiple sheets and doublers can provide flow passages to face sheet pressure equalization holes.
Figure 10D:
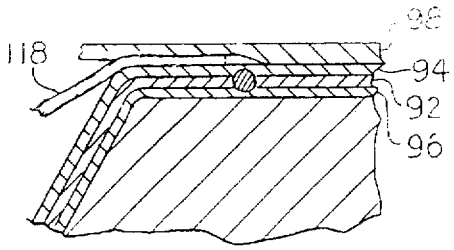
FIG. 10D is a cross-sectional view of a die similar to that of FIG. 9 showing how a wire in a machined or chemical milled groove can provide flow passages to a face sheet pressure equalization hole.
Figure 10E:
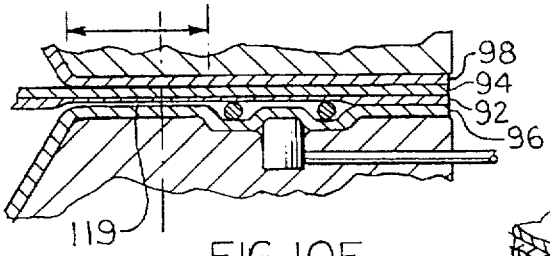
FIG. 10E is a cross-sectional view of a die similar to that of FIG. 9 with a system to provide a gas connection to the forming pack, which becomes attached to the forming pack during the process so it can be used after the formed part is removed from the die.
Figure 10C:
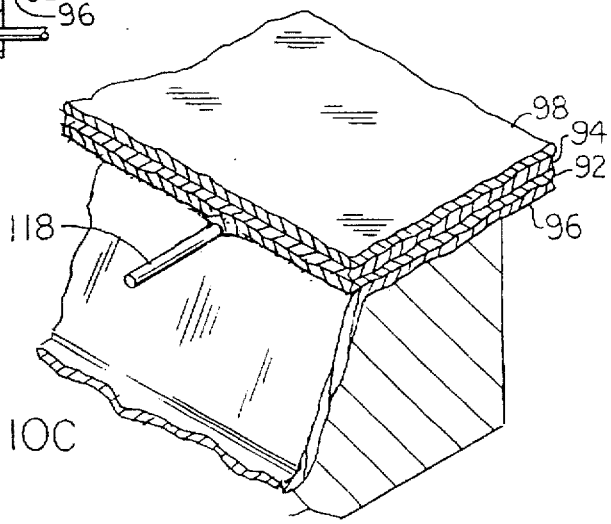
FIG. 10C is a perspective view of the die showing how a wire can provide flow passages to face sheet pressure equalization hole.

Face sheet pressure equalization holes can be located in a trim area of a panel when suitable dies 80 such as shown in FIG. 9 are used. At least one of the dies 80 includes a pressure relief 82 in the outer edge surface 84 thereof that extends into the forming cavity 86 thereof. As shown in FIG. 10A, a forming pack 90 including core sheets 92 and 94, and face sheets 96 and 98 are positioned on the edge surface 84 with seam welds 99 extending into the trim area 100 defined by cut lines shown as dashed lines 102 and 104. An area 106 between the welds 99 is sealed by two spaced welds 110 and 112 that extend across the welds 99. The pressure equalization hole 114 is drilled through the area 106 of the core sheets 92 and 94. When the face sheets 96 and 98 are formed in the die 80 and a matching die (not shown) including a pressure relief in the same area, portions of the face sheets 96 and 98 are formed into a relief passage 116 (shown with face sheet 96) to allow free gas flow through the pressure equalization hole 114 and about the core sheets 92 and 94. This way of providing pressure relief is particularly advantageous when the dies 80 also can seal the sheets 92, 94, 96, and 98 about their edges and include gas passages that seal to the forming pack 90. Then the only welds that need to be made are rollseam welds, with all peripheral and tube welding eliminated. This improvement can also be used when forming the multi-sheet core panels as shown in U.S. Pat. No. 5,141,146 by Yasui and in U.S. Pat. No. 5,204,161 by Pettit et al. If the pressure relief 82 cannot be used, then gas passages can be formed in other ways. In FIG. 10B, the face sheet 96 is shown formed by two half thickness face sheets 96*a* and 96*b* with a slot cut in sheet 96*b* to form a gas passage. Gas passages can also be formed by placing a suitably shaped doubler 117 between the appropriate sheets to form a gas passage. As shown in FIGS. 10C and 10D gas passages can be formed by laying a wire 118 between sheets 92 and 96, and 94 and 98 where the gas passages are desired as superplastic forming there about always leaves passages. The wire 118 in FIG. 10D is positioned between sheet 98 and sheet 94. As shown in FIG. 10E, a sheet (shown as sheet 92) can have a groove 119 instead of the wire 118 to also form a gas passage.

Figure 11:
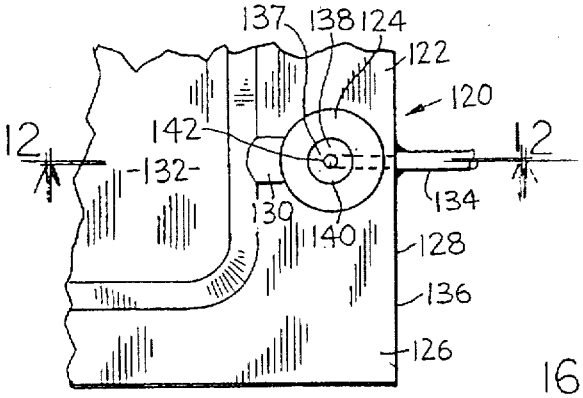
FIG. 11 is a partial top view of a die with a forming pack gas pressure interface incorporated therein.
Figure 12:
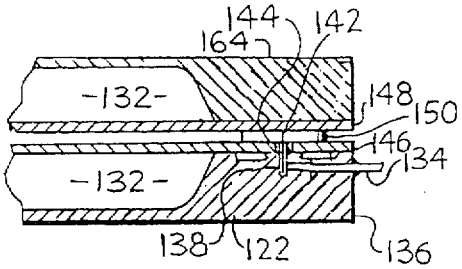
FIG. 12 is a cross-sectional view taken at line 12—12 in FIG. 11.

A gas inlet system 120 for a die 122 that eliminates the need for any tube welding to a forming pack is shown in FIG. 11. The gas inlet system 120, which is suitable for metal dies and dies of other materials having good gas sealing characteristics, includes at least one ring shaped depression 124 formed in a die mating surface 126 at the edge 128 of the die 122. A galley 130 extends from the ring depression 124 into the main forming cavity 132 of the die 122. A gas passage 134 extends through the side 136 of the die 122 and up through the radial sealing surface 137 of a seal protrusion 138 in the center 140 of the ring depression 124. A centering pin 142 extends out of the gas passage 134 at the seal protrusion 138 so that a hole 144 in the lower of two sheets 146 and 148 to be formed (FIG. 12) can be kept in alignment therewith.

Figure 13:
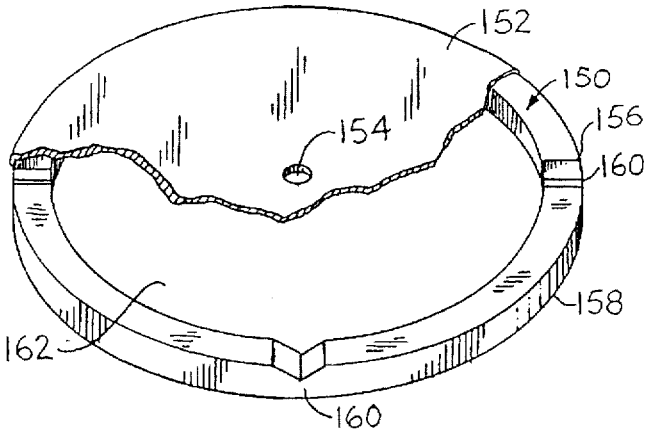
FIG. 13 is an enlarged perspective view of the sealing ring of FIG. 12.
Figure 14:
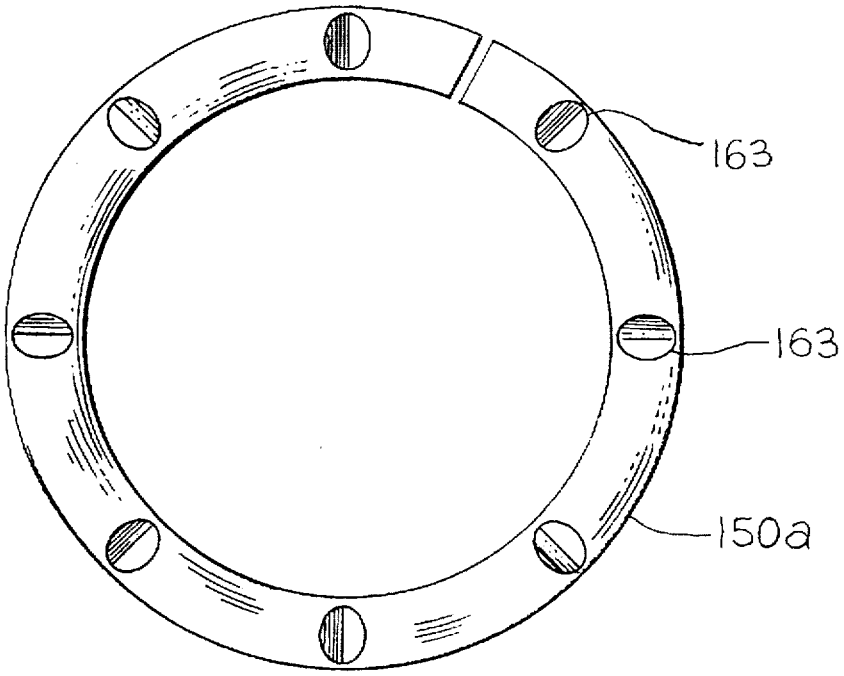
FIG. 14 is an enlarged top view of an economical sealing ring that can be substituted for the ring of FIG. 13.

A seal ring 150, as shown in FIG. 13, is placed between the two sheets 146 and 148 about the hole 144 and is aligned with the ring depression 124 by the pin 142 and a centering cover 152 having a central hole 154 for engagement about the pin 142. The seal ring 150 includes upper and lower sealing surfaces 156 and 158 and one or more gas passages 160 radially there through to communicate its center 162 and the gas passage 134 with a passageway between the sheets 146 and 148 that forms through the galley 130 during the forming process. A more economic version 150*a* of the ring 150 is shown in FIG. 14, wherein a titanium coil has been cut into titanium rings 150*a*. Each ring 150*a* has gas passages 163 depressed therein by merely cutting the ring 150*a* partially with bolt cutters, or a hammer and chisel at spaced locations there around.

An upper die 164 is pressed down onto the sheets 146 and 148, and the ring 150 to form a seal about the mating surface 126 as the whole assembly is heated to superplastic forming temperatures. Pressurized gas is then fed through the gas passages 134 and 160 to expand the sheets 146 and 148 into the shape of the forming cavity 132. Once the part has formed, the assembly is cooled and the part, ready for trimming and surface finishing, is removed from the dies 122 and 164. If the tolerances are correct and the dies are not constructed from ceramic material (ceramic dies have poor gas sealing characteristics), the dies 122 and 164 can be used to form a single sheet 146, with the ring 150 providing gas passages to above the galley 130 so that the sheet 146 deforms into the galley 130 to form a gas passage above the sheet 146 and the forming cavity 132 and below the die 164.

Figure 15:
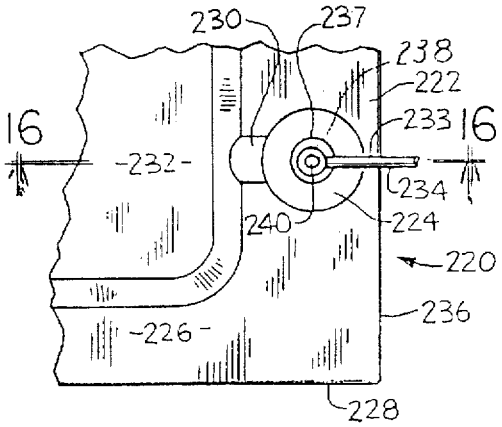
FIG. 15 is a partial top view of a die with a modified gas pressure interface incorporated therein.
Figure 16:
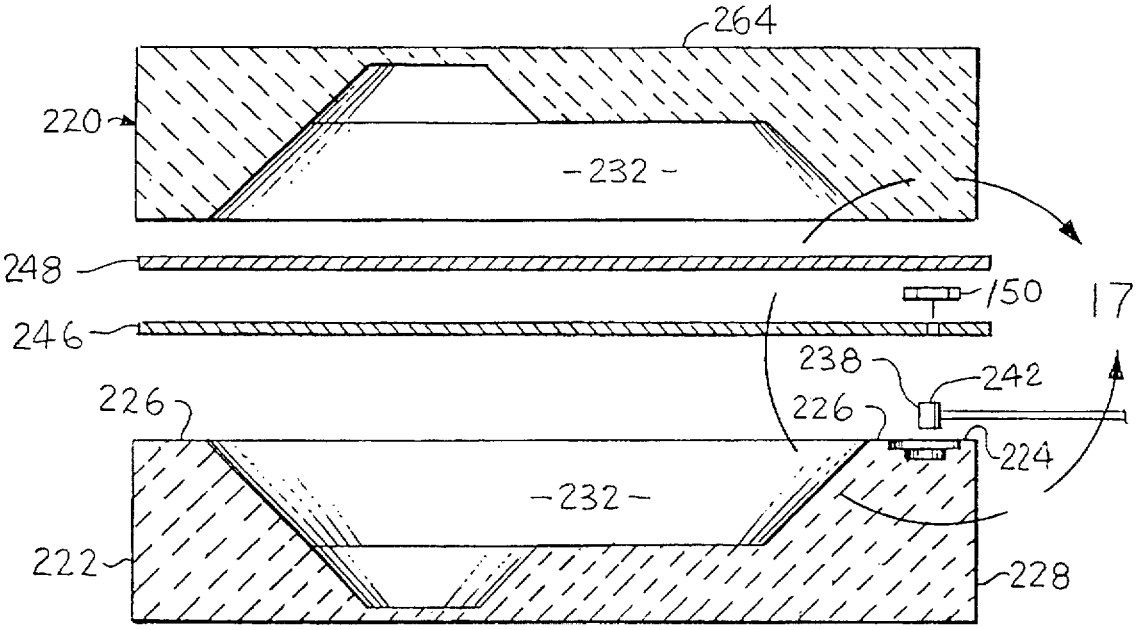
FIG. 16 is an enlarged exploded cross-sectional view taken at line 16—16 of FIG. 15.
Figure 17:
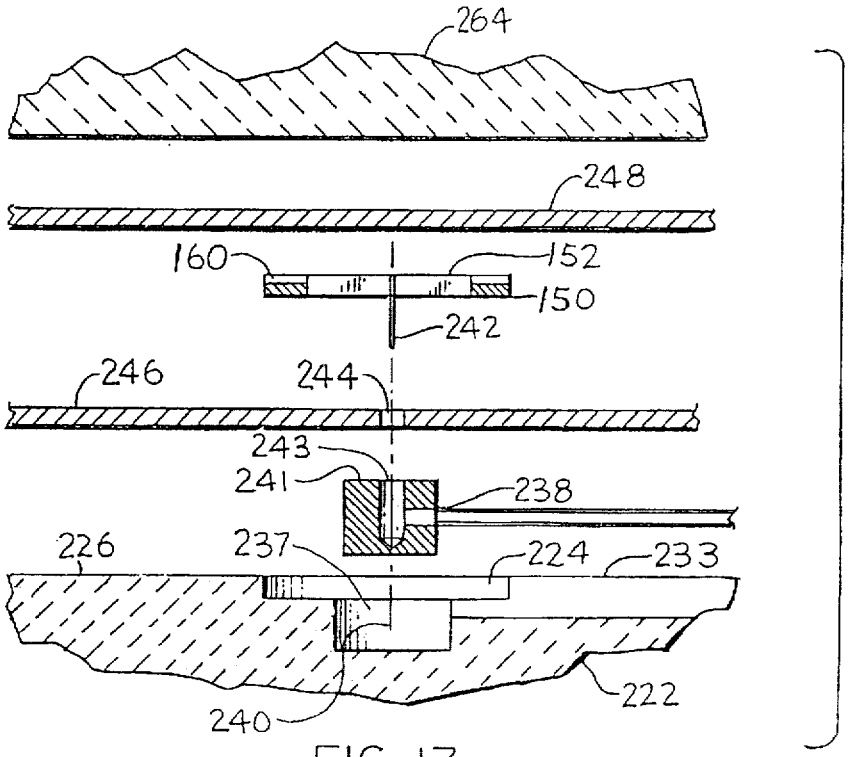
FIG. 17 is an enlarged detail view of the area 17—17 of FIG. 16.

It is desirable to unload formed parts from the forming die hot (over 1400° F. for some alloys). Hot unloading improves part properties, lengthens die life, and shortens processing time. However, when the temperature of a titanium part exceeds 900° F., the internal and external surfaces of the part are subject to oxidation embrittlement. Exterior surface oxidation can be removed by chemical milling but internal surface oxidation is more difficult and for some configurations impossible to remove. To preclude internal surface oxidation, inert gas must be introduced into the interior cavity(s) of the part if it is to be unloaded hot. The interior of the part also must be pressurized to prevent the part from collapsing due to the reduction of internal gas volume during sudden cool down. The system 120 described above does not allow inert gas to be used to pressurize the formed part once it is out of the dies 122 and 164. Therefore, when the part is to be removed hot, the modified system 220 shown in FIGS. 15, 16, and 17 is used to provide at least one continuing inert gas connection to the interior volume(s) of the part.

The gas inlet system 220 for a die 222 includes a ring shaped depression 224 formed in a mating surface 226 at the edge 228 of the die 222. A galley 230 extends from the ring depression 224 into the main forming cavity 232 of the die 222. A groove 233 for a gas passage tube 234 extends from the side 236 of the die 222 to a depression 237 for a seal member 238 in the center 240 of the ring depression 224. The seal member 238 fits within the depression 237 extending upwardly so that its upper radial surface 241 ends up located just like the radial sealing surface 137 of the seal protrusion 138. The gas passage tube 234 is attached thereto and fits within the groove 233. A centering pin 242 extends out of the gas passage 243 formed by the tube 234 and the seal member 238 so that a hole 244 in the lower of two sheets 246 and 248 to be formed can be kept in alignment therewith and with the seal ring 150 positioned as before between the two sheets 246 and 248. The seal member 238 is made from a diffusion bondable material such as titanium.

Once the part has been formed from the sheets 246 and 248, the forming pressure is reduced to a point where the part does not collapse nor further expand, and the part with the seal member 238 diffusion bonded thereto, is removed from the dies 222 and 264. The part is then cooled out of the dies 222 and 264 so the dies 222 and 264 can be used to form the next part. The pressurized inert gas that can be maintained in the part through the seal member 238 prevents internal surface oxidation. Multiple applications of system 220 in FIG. 15 to a part allows it to be purged with a flow of cool inert gas for quicker cooling of any internal structures thereof. Not only does the system 220 allow the die members 222 and 264 to be used to build more parts during a shift, the energy cost per part is greatly reduced because when directly electrically heated, only the forming pack of two or more sheets, which has relatively little heat capacity with respect to what are normally massive dies, need be heated up to superplastic forming temperature. The system 220 requires at least two sheets 246 and 248 and does not necessarily rely on any part of the dies 222 or 264 to form sealing surfaces. Therefore the dies 222 and 264 can be made from ceramic material, which has a superior working lifetime and high electrical impedance, but poor gas sealing properties. To form a four sheet Hayase part, both systems 120 and 220 may be employed, system 120 for face sheet forming and exhaust, and system 220 for web forming, since after a Hayase part has formed, the interior thereof is only the volume between the web forming sheets.

Figure 18:
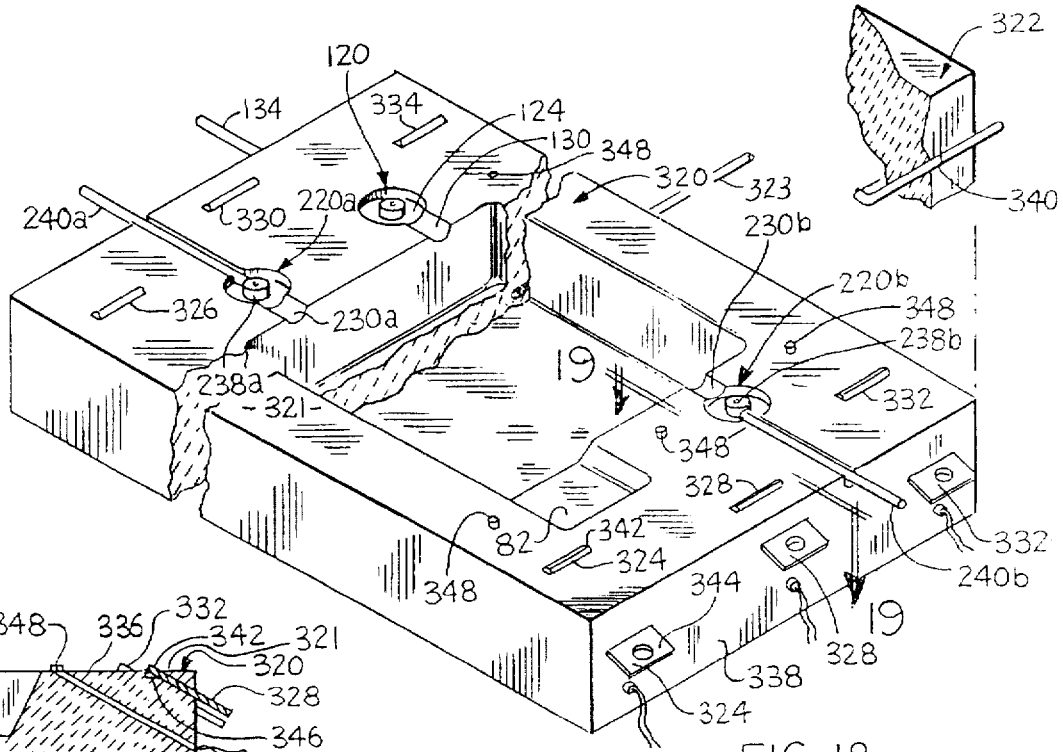
FIG. 18 is a broken perspective view of dies of the present invention incorporating electrical resistance heating electrodes and thermocouples.
Figure 19:
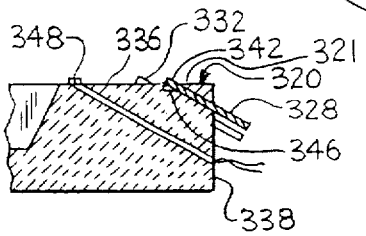
FIG. 19 is a partial side cross-sectional view taken at line 19—19 of FIG. 18.

Dies 320 and 322 shown in FIGS. 18 and 19 include the gas interface system 120, two gas interface systems **220*a* and 220*b*, and a pressure relief 82 positioned in the peripheral edge 321 of die 320 as shown in FIG. 19 so that no pressure connections have to be pre-established with a blank before the blank is inserted there between. Two gas interface systems 220*a* and 220*b* are used to connect within the core sheets so that a flow of cool inert gas can be established within a formed part to cool it both within the dies 320 and 322 and outside thereof. A forming cavity vent 323 is also included even though if the dies 320 and 322 are made from ceramic, the interface between the blank and the dies 320 and/or 322 is rarely a good enough seal to require one. The die 320 includes pairs of electrodes 324 and 326, 328 and 330, and 332 and 334 that extend from the peripheral edge surface 321 thereof to its outer edge 338. The electrodes 324 and 326, 328 and 330, and 332 and 334 may be wider than shown (they may even overlap) to provide large contactsurfaces for current transfer into the blank. Pairs of electrodes may also be included in the upper die 322 as shown by electrode 340. As shown with electrode 324, each of the electrodes includes a blank contact area 342 and a connection tab 344 to transfer electricity between an electrical power source and the blank. The area 346 of the die 320 is relieved behind the contact area 342 so when a blank is forced there against, the contact area of the electrode can flex back to maintain biased contact with the blank. One or more thermocouples 348 are positioned in the peripheral edge surface 321 where they can contact a blank so that its temperature can be monitored when current is supplied across pairs of electrodes to directly heat the blank. Note that the center pair of electrodes 328 and 330 are spaced further apart than the pairs of electrodes 324 and 326, and 332 and 334** so that the current flow and hence the heating of the blank caused thereby is more uniform, although uniformity of heating also can be controlled by varying the current applied across electrode pairs.

It is preferable that the dies 320 and 322 be constructed from ceramic or like material that has low heat and electrical conductivity and can withstand high temperatures at die surfaces. However, generally the blanks have low impedance so high voltages are not required to heat them. This allows the use of surface insulator coatings on conductive metal dies, if metal dies are preferred, so the blank heating current does not short out through the die.

Figure 20:
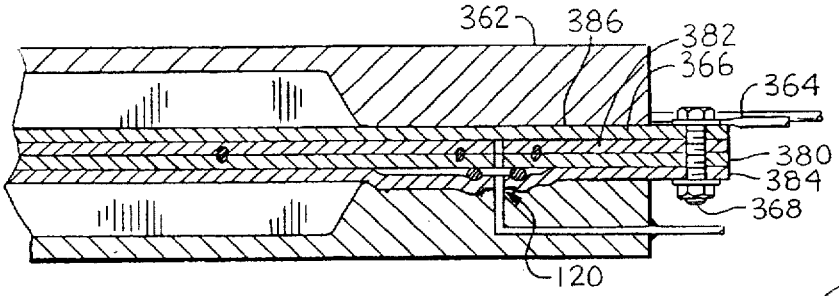
FIG. 20 is a partial side cross-sectional view of a pair of dies similar to those of FIG. 16 without built in electrodes.
Figure 21:
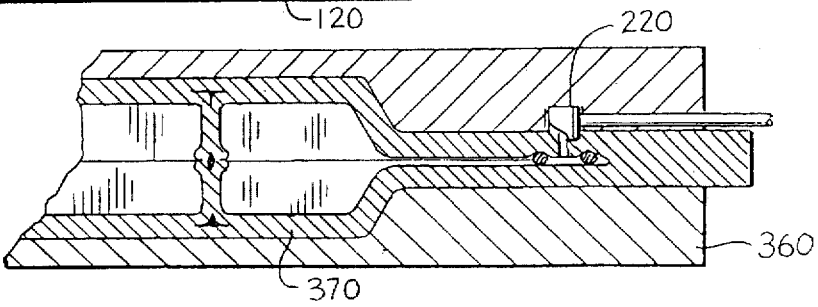
FIG. 21 is a partial side cross-sectional view of the pair of dies of FIG. 20 showing the formation of a Hayase panel therein.
Figure 22:
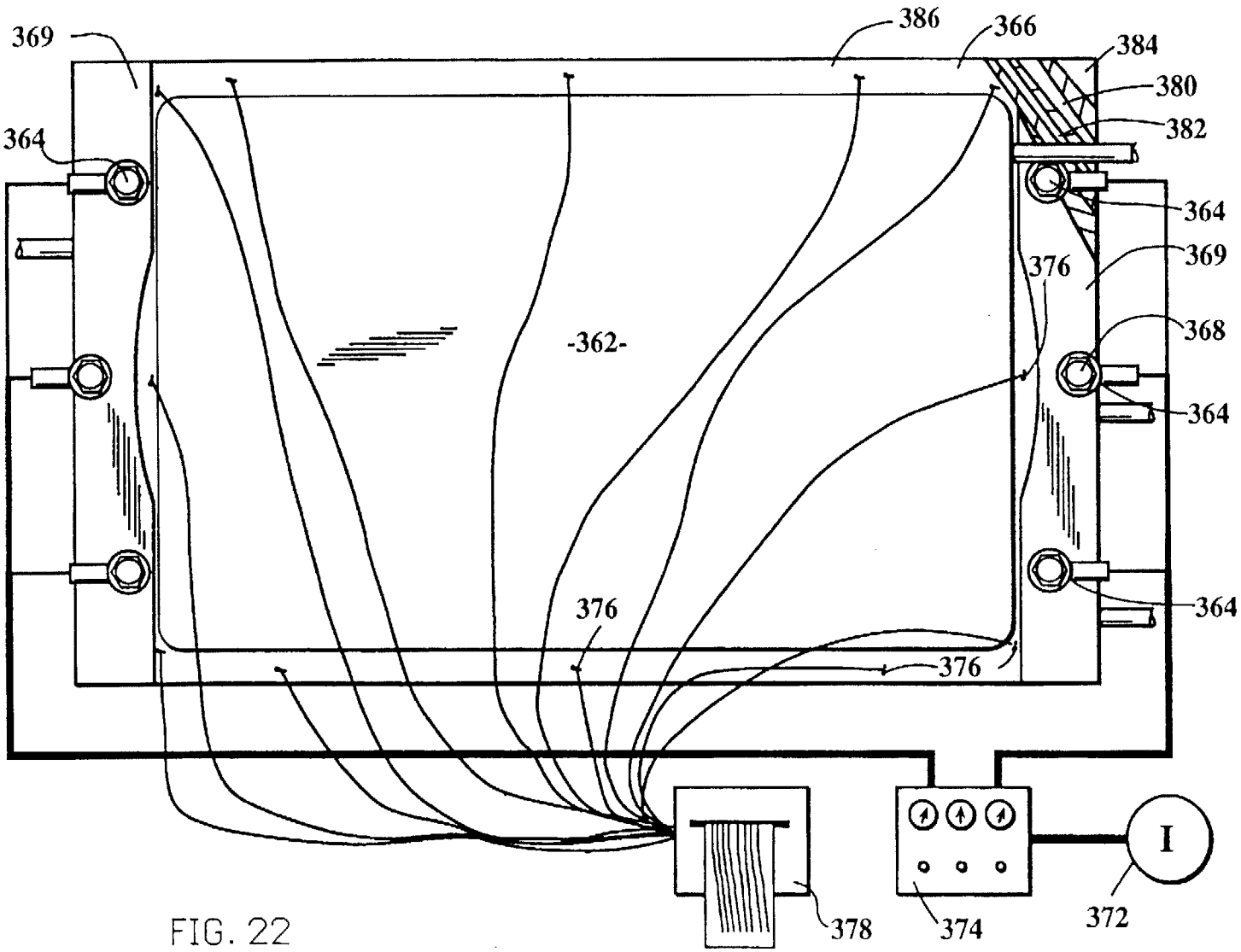
FIG. 22 is a top plan view of a forming pack with its electrical connections and thermocouples within forming dies, the electrical connections being positioned to cause relatively uniform heating of the forming pack.

As shown in FIGS. 20, 21, and 22, dies 360 and 362 do not have to include electrodes, the current connections 364 being fastened directly to the blank 366 by suitable fasteners 368 and doublers 369 (FIG. 22). The doublers 369 may be shaped to even out current flow and may be constructed from copper or other highly electrically conductive materials to distribute the current and prevent high temperatures from occurring adjacent the connections 364, or when a minimal number of sheets are being used, the doublers 369 may be of the superplastic formable material to lower the resistance adjacent the connections 364 and reduce the heating thereat. Such configuration is preferred when insulated conductive dies are used. The dies 360 and 362 having gas interface systems 120 and 220, are shown in FIGS. 20 and 21 being used to form a Hayase type panel 370. The current connections 364 (FIG. 22) are attached to a current source 372 through a manual controller 374 with which it is possible to vary the current between pairs of connections 364 in response to the temperatures sensed by thermocouples 376 adjacent to the blank 366 and read out on a chart recorder 378.

Figure 23:
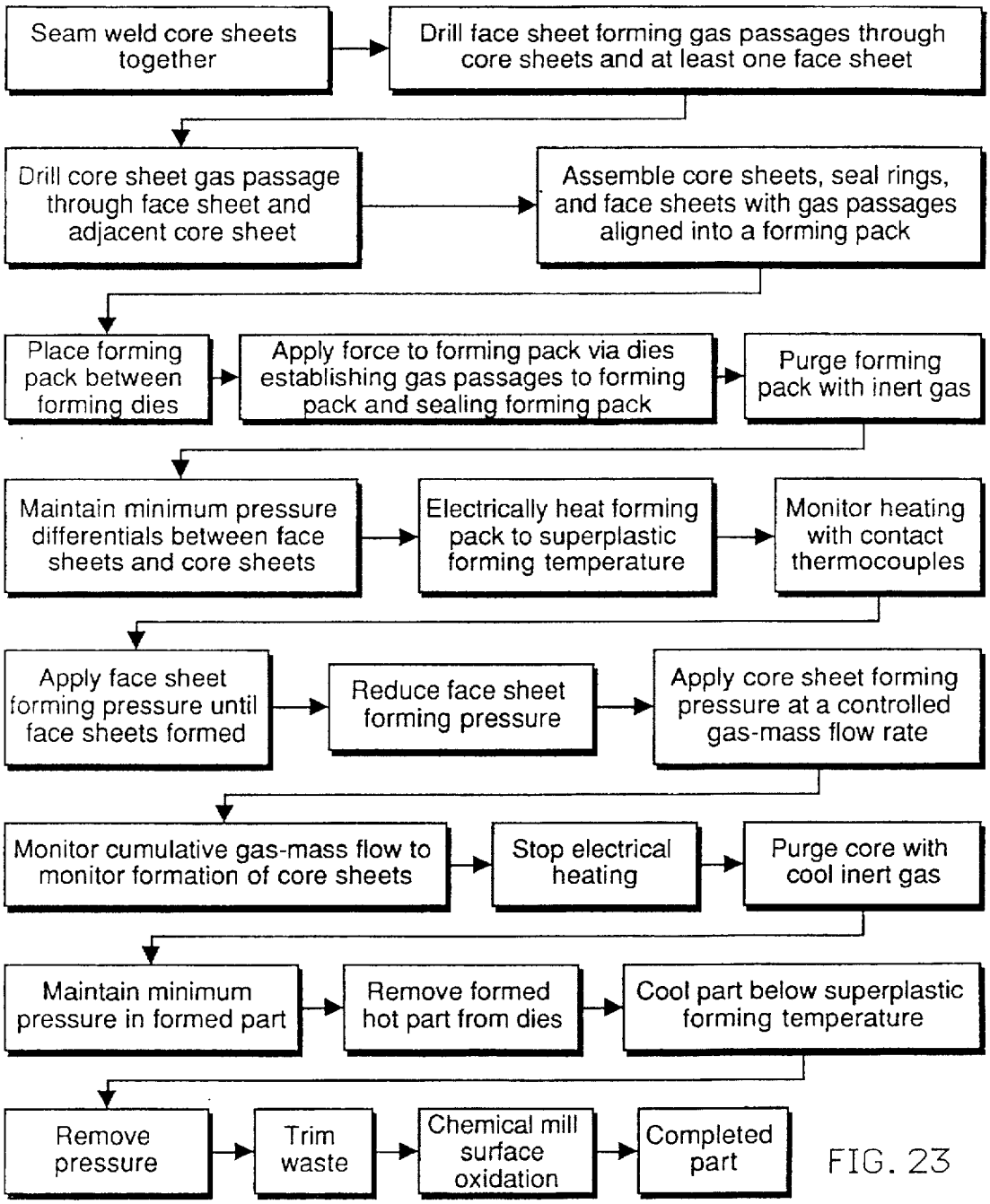
FIG. 23 is typical process diagram of the present invention.

FIG. 23 is a flow chart of a typical process to make a Hayase type panel performed in the dies 320 and 322, or 360 and 362. First core sheets 380 and 382 are seam welded together and suitable holes are drilled to interface with the systems 120 and 220 and establish one or more face sheet pressure equalization holes. The core sheets 380 and 382 and the face sheets 384 and 386 are assembled with sealing rings 50 into a forming pack, which then is placed between the dies positioned in a press. The force of the press establishes the initial gas seals so that the pack can be purged with inert gas. Proper gas pressures are maintained within the pack to prevent unwanted diffusion bonding and electrical current is applied across the forming pack until thermocouples indicate that the pack is at superplastic forming temperature. The face sheets 384 and 386 are then formed followed by formation of the core sheets 380 and 382. Although gas-mass forming may be used for face sheet forming, it is used for core sheet forming where superplastic formation is more critical so that small variations in temperature can be tolerated. Once the panel is formed, the current is turned off. Since the dies do not heat appreciably during the formation of the panel, especially if they are made from ceramic material, the formed part cools relatively rapidly, especially if it is purged with cool inert gas. When the panel has cooled sufficiently so it can maintain its shape outside the dies, the panel is removed from the dies while inert gas is maintained within the panel's interior to prevent interior surface oxygen embrittlement until the panel is below its oxidation temperature. In some instances, the purging inert gas is maintained in the panel at a pressure above atmospheric to stabilize the panel while it is still relatively hot, allowing earlier removal from the dies. When the panel has cooled below its surface oxidation temperature, which is always below its physical stability temperature, any remaining pressure in the interior of the panel is removed, the edge waste is trimmed, the exterior surface oxidation is removed, and the panel is ready for use.

Thus, there has been shown novel SPF/DB processes using direct electrical heating, which fulfill all of the objects and advantages sought therefor. Many changes, alterations, modifications and other uses and applications of the subject invention will become apparent to those skilled in the art after considering the specification together with the accompanying drawings. All such changes, alterations and modifications which do not depart from the spirit and scope of the invention are deemed to be covered by the invention which is limited only by the claims that follow.

I claim:

1. A superplastic forming process performed between at least two dies that interface gas passages to one or more superplastically formable sheets as a blank to be superplastically formed there within, the process including:

placing the blank in the at least two dies;

establishing at least one gas interface from the at least two dies to the blank;

connecting an electrical current source to opposite edges of the blank;

heating the blank to superplastic forming temperature by:

applying current from the electrical current source through the blank;

applying pressurized inert gas from the at least one gas interface to the blank at a controlled rate to form the one or more superplastically formable sheets thereof;

cooling the formed blank by:

stopping the application of current through the blank; and removing the formed blank from the at least two dies.

2. The process as defined in claim 1 wherein the application of pressurized inert gas from the at least one gas interface to the blank at a controlled rate includes:

controlling the pressurized inert gas by:

introducing the pressurized inert gas at a controlled gas-mass flow rate, whereby minor temperature differences in the blank do not adversely affect its formation.

3. The process as defined in claim 1 wherein the heating of the blank to superplastic forming temperature includes:

measuring the temperature of the blank; and reducing the rate at which current is applied when the temperature of the blank reaches superplastic forming temperature.

4. The process as defined in claim 1 wherein the heating of the blank to superplastic forming temperature includes:

maintaining the dies at a temperature near ambient temperature.

5. The process as defined in claim 1 wherein the blank includes at least two sheets, the process further including:

purging the blank with inert gas prior to the heating of the blank.

6. The process as defined in claim 1 wherein the blank includes at least two sheets, and wherein the cooling of the formed blank is also accomplished by:

purging the blank with cooler inert gas.

7. The process as defined in claim 6 wherein the purging of the blank with ambient inert gas is accomplished at a pressure elevated above ambient and continued after the formed blank is removed from the at least two dies.

8. The process as defined in claim 1 wherein the blank includes at least two sheets, and wherein the cooling of the formed blank is accomplished while maintaining the pressurized inert gas at a pressure elevated above ambient pressure, which is continued after the formed blank is removed from the at least two dies.

9. The process as defined in claim 1 wherein the formed blank is removed from the at least two dies before the formed blank has been cooled below superplastic forming temperature.

10. The process as defined in claim 1 wherein at least one of the at least two dies is constructed from ceramic material.

11. The process as defined in claim 1 wherein the blank includes at least first and second sheets, and wherein the establishing at least one gas interface from the at least two dies to the blank includes:

providing two of the at least two dies with: a forming cavity in at least one of the dies, mating edge surfaces, at least one of the edge surfaces having a sealing ring depression therein which has a gas passage extending therein from outside the die, and a galley that extends from the sealing ring depression to the forming cavity;

providing a hole in the first sheet of the blank so the hole is in gas communication with the gas passage when the blank is placed in the at least two dies;

placing a sealing ring having at least one gas passage formed there through about the hole opposite the sealing ring depression and between the first and second sheets; and forcing the mating edges surfaces toward each other to seal the first sheet against the dies.

12. The process as defined in claim 11 further including:

providing a seal depression in at least one of the dies centered in the ring depression and a tube galley from the seal depression to the edge of the at least one die;

providing a seal member with a gas passage tube in the seal depression and the tube galley, the seal member having a surface in contact with the first sheet and being constructed from a material that can be diffusion bonded to the first sheet at superplastic forming temperatures; and diffusion bonding the seal member surface to the first sheet as the blank is superplastically formed.

13. The process as defined in claim 1 wherein the connecting an electrical current source to opposite edges of the blank includes:

connecting at least two end electrical connectors and a central electrical connector to each of the opposite edges, the two end electrical connectors on each edge being positioned closer to each other than the central electrical connectors to even the flow of current across the blank.

14. The process as defined in claim 1 wherein the connecting an electrical current source to opposite edges of the blank includes:

connecting at least two end electrical connectors and a central electrical connector to each of the opposite edges; and establishing more current flow through the end electrical connectors than through the central electrical connectors to even the flow of current across the blank.

15. A die for a superplastic forming process wherein the blank to be superplastically formed is directly heated by electrical current, the die including:

a peripheral edge surface for engaging a blank to be superplastically formed;

a forming cavity within said peripheral edge surface; and a least one pair of spaced electrodes positioned with said forming cavity there between and extending through said peripheral edge surface positioned for electrical contact with a blank engaging said peripheral edge surface.

16. The die for a superplastic forming process as defined in claim 15 further including:

at least one temperature measuring device positioned on said peripheral edge surface for measuring the temperature of a blank engaged therewith.

17. The die for a superplastic forming process as defined in claim 15 further including:

at least one gas interface extending through said peripheral edge for supplying pressurized gas to form the blank.

18. The die for a superplastic forming process as defined in claim 17 wherein said at least one gas interface includes:

a gas connector extending from said die outside said peripheral edge surface;

a seal depression in said peripheral edge surface;

a seal protrusion in said seal depression; and a first gas passage extending from said seal protrusion to said gas connector.

19. The die for a superplastic forming process as defined in claim 18 wherein said at least one gas interface includes:

a passageway extending from outside said peripheral edge surface along said peripheral edge surface to said seal depression, and wherein said seal protrusion is a protrusion member that nests in said seal depression and is constructed from diffusion bondable material, said gas connector being:

a gas tube connected to said protrusion member that rests in said passageway when said protrusion member is nested in said seal depression.

20. The die for a superplastic forming process as defined in claim 18 wherein said peripheral edge surface includes:

a galley therein for forming a gas passageway in the blank.

21. The die for a superplastic forming process as defined in claim 15 further including:

at least two additional pairs of electrodes positioned with said forming cavity there between and extending through said peripheral edge surface positioned for electrical contact with a blank engaging said peripheral edge surface, said at least two additional pairs of electrodes being positioned with said at least one pair of electrodes positioned there between, said at least one pair of electrodes being positioned further apart than said electrodes of said at least two additional pairs of electrodes.

22. A blank for positioning in a die for a superplastic forming process including:

at least one sheet of superplastically formable, electrically conducting material having:

first and second opposite edge portions; and a central portion to be superplastically formed positioned between said first and second edge portions;

at least one first electrically conducting doubler positioned adjacent said first edge portion; and at least one second electrically conducting doubler positioned adjacent said second edge portion, said at least one first and second doublers lowering the electrical resistance at said first and second edge portions so that electrical current applied between said first and second edge portions heats said central portion more than in said first and second edge portions.

23. The blank as defined in claim 22 wherein said at least one first and second electrically conducting doublers are shaped to provide even electrical flow and hence even electrical heating to said central portion.

24. The blank as defined in claim 22 wherein said at least one first and second electrically conducting doublers are constructed from a material that has less electrical resistance than said at least one sheet of superplastically formable, electrically conducting material.

25. The blank as defined in claim 22 wherein said at least one first and second electrically conducting doublers are constructed from superplastically formable, electrically conducting material.

* * * * *